United States Patent [19]

Alspaugh

[11] Patent Number: 4,724,798

[45] Date of Patent: Feb. 16, 1988

[54] OUTDOOR WOODBURNING FURNACE

[76] Inventor: Robert D. Alspaugh, Box 1298, Clarendon, Pa. 16313

[21] Appl. No.: 1,845

[22] Filed: Jan. 9, 1987

[51] Int. Cl.[4] ..... F22B 31/04

[52] U.S. Cl. ..... 122/15; 126/65; 126/77; 126/83; 126/132; 126/362; 126/101; 237/56

[58] Field of Search ..... 126/121, 132, 101, 361, 126/83, 362, 65–67, 77, 367, 34, 368, 35, 60, 61; 122/15, 20 B; 237/8 R, 56

[56] References Cited

U.S. PATENT DOCUMENTS 1,432,551 10/1922 Harper ..... 126/132
4,461,242 7/1984 Black ..... 126/132

FOREIGN PATENT DOCUMENTS 192090 9/1957 Fed. Rep. of Germany ..... 122/15
2542849 7/1984 France ..... 126/132
578581 7/1946 United Kingdom ..... 126/132

*Primary Examiner*—James C. Yeung
*Attorney, Agent, or Firm*—Charles L. Lovercheck; Wayne L. Lovercheck; Dale R. Lovercheck

[57] ABSTRACT

An outdoor wood-fired furnace which heats water for domestic use and provides heat is disclosed. The furnace has a water jacket, sides, top and ends. A main distribution chamber is provided for air on its bottom with outlet means to the firebox. The water jacket includes a large containment area in the top and an L-shaped baffle, having a horizontal leg and a vertical leg. Behind and above this L-shaped baffle is a similarly shaped air space which provides a passage between the baffle and the liquid cooled rear wall and the container for hot gases from the firebox to enter a flue. Means is provided to emit air from the main distribution chamber side through pipes to the fire.

20 Claims, 7 Drawing Figures

OUTDOOR WOODBURNING FURNACE

GENERAL STATEMENT OF THE INVENTION

This wood-fired furnace heats liquid for use in heating homes, etc. and for supplying domestic hot water for potable and general use. It consists of a jacketed firebox substantially surrounded by liquid in that jacket. Penetrations through the jacket into the firebox allow for fuel loading, ash removal, air intake, cleanout, and exhausting flue gases. The unit is also insulated from the elements to reduce heat loss. As an option to an iron "grid" grate, immovable water pipes at the bottom may support the fuel bed and provide for additional heat transfer. They are spaced to allow a part of the primary draft to pass up through for combustion.

The firebox is constructed to include a liquid filled baffle which makes up the rear and top of the firebox. Flue gases must go under, and behind the baffle before being exhausted from the flue. The additional baffle surface area enables more heat to be exchanged into the liquid.

A multi-zoned draft is generated using a blower and an air distribution apparatus. This draft is preheated as it passes through a chamber which has one thick steel wall exposed to hot coals near the bottom of the firebox. Extensions from this chamber carry the preheated air to strategic areas in the firebox to mix with the volitiles and enable very clean burning to take place. The oxygen enriched mixture then ignites when it comes in contact with live coals as it goes under the baffle in the rear. The burning gases must travel beneath the liquid filled baffle which extends vertically in the rear to horizontally above the firebox. The gases then travel behind the baffle the full length before being exhausted. This allows a very high level of combustion to take place. When no draft is desired, a closing mechanism seals unwanted air from entering. A manual switch is provided which activates the blower to evacuate the volatile smoke in the firebox before opening the loading door. As an option, a damper is provided, in an opening through the baffle, which can be opened to allow a direct exit of the gases out the flue during the early stages of burning and when adding fuel.

The unit is rectangular in shape and the liquid is stored in the space between the firebox and outer shell. The unit may be either open or closed to the atmosphere. The closed arrangement is dependent upon provision for liquid expansion and pressure relief devices; construction must include staybolts to withstand the normal pressures in a system. The open arrangement must have an overflow and filling provision; materials need to be rigid enough to withstand static loads or include a sufficient number of staybolts to hold the shape.

Copper coils are suspended in the upper tank portion of the unit through which (1) domestic water passes; and/or (2) as an alternate to circulating the heated liquid to provide heat from an open system, the heating liquid can flow through a coil to a pressurized system. It is situated to provide for complete draining.

SUMMARY OF THE INVENTION

This heating device is intended primarily for installation outside any building. Inside installation will use the closed system. It is important that a suitable flue be utilized. Wood or other low grade combustibles can be used for fuel. The liquid surrounding the firebox absorbs the heat and is circulated into the user facility through pipes, hoses, radiators or other type heat exchangers with the aid of circulating pump(s). Standard thermostats and controls are applied as necessary to (a) circulate hot liquid when the user facility calls for heat, (b) start blower(s) which generate draft to increase the burning rate of the fuel (to raise liquid temperature), and (c) operate various valves/systems as needed.

The provision for a domestic water coil may or may not utilize a circulating pump. The open system may include an additional coil or other heat exchanger in the top through which the heating liquid may be circulated to the user facility to accommodate a closed system. The device is similar to many being marketed at this time, however, this design claims the following improvements which increase efficiency:

1. An air distribution apparatus which preheats the draft air and routes it to mix with volatiles from the fuel. Perforations in the distribution apparatus create "curtains" of air which direct the mixture towards live coals for more complete burning before and during the exit of gases out the flue. These "curtains" of air enable more complete combustion of the volatiles as the gases become more saturated with the oxygen rich air. Three areas where mixing and/or burning take place are: (1) the primary burning area in the firebox near the grate in the bottom, (2) the secondary mixing area in the firebox above the fuel supply, and (3) near the bottom of the baffle where gases are ignited and behind the baffle as they are forced upward toward their exit out the flue.

2. A liquid filled baffle which directs gases for more complete burning and increases the flame/heat impingement area by almost fifty (50) percent (thus increasing the BTU output). An optional penetration through the top part of the baffle hosts a damper which allows gases to go directly into th flue when it is opened. The liquid inside the baffle self circulates by pulling in cooler liquid near the bottom as warmer, rising liquid exits near the top.

3. The liquid filled baffle has inclined (instead of horizontal) top and bottom which allows the liquid to migrate along the surface as it heats thus eliminating hot spots.

4. Inclined water grates (an option) which allow liquid to migrate along the pipe length to the opposite end of the liquid jacket as it heats.

OBJECTS OF THE INVENTION

It is an object of the invention to provide an improved solid fuel fired furnace.

Another object of the invention is to provide an improved water jacketed furnace.

Another object of the invention is to provide a water jacketed heating furnace for heating potable water.

Another object of the invention is to provide an improved water jacketed furnace that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF DRAWINGS

Figure 3:
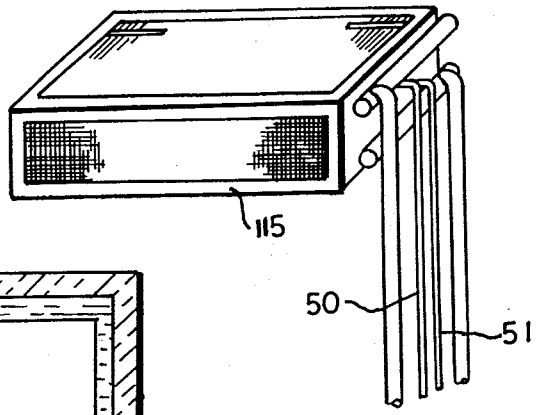
FIG. 3 is an enlarged view of an optional heating coil shown for use in FIGS. 1, 4, 5, 6 and 7.
Figure 2:
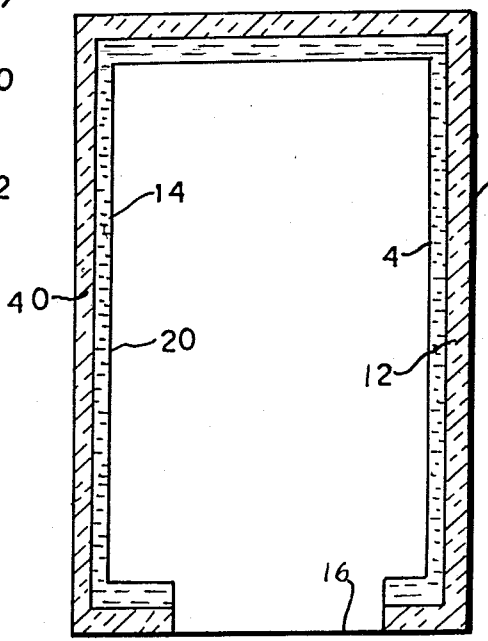
FIG. 2 is is a lateral cross-sectional view of the furnace shown in FIG. 1.
Figure 1:
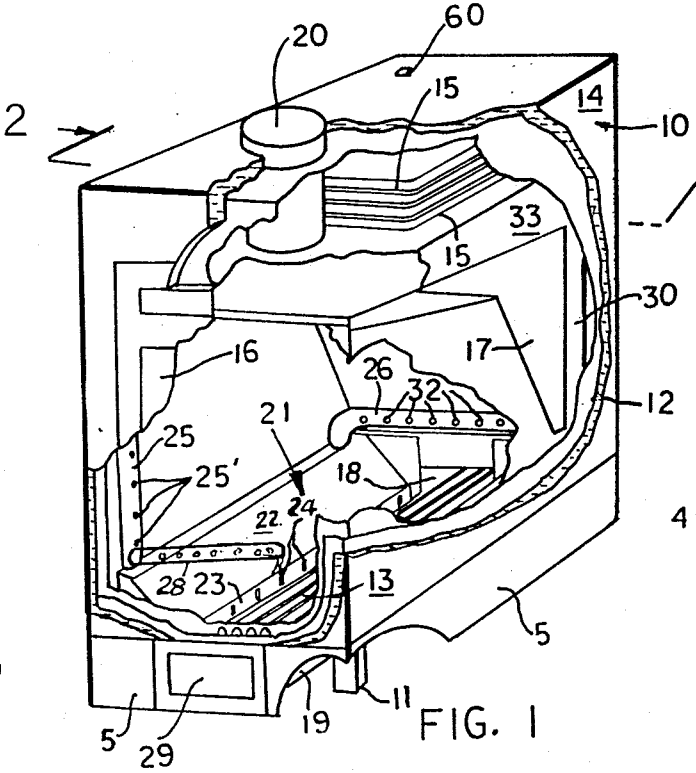
FIG. 1 is an isometric view of the furnace with the outside wall broken away, according to the invention.
Figure 5:
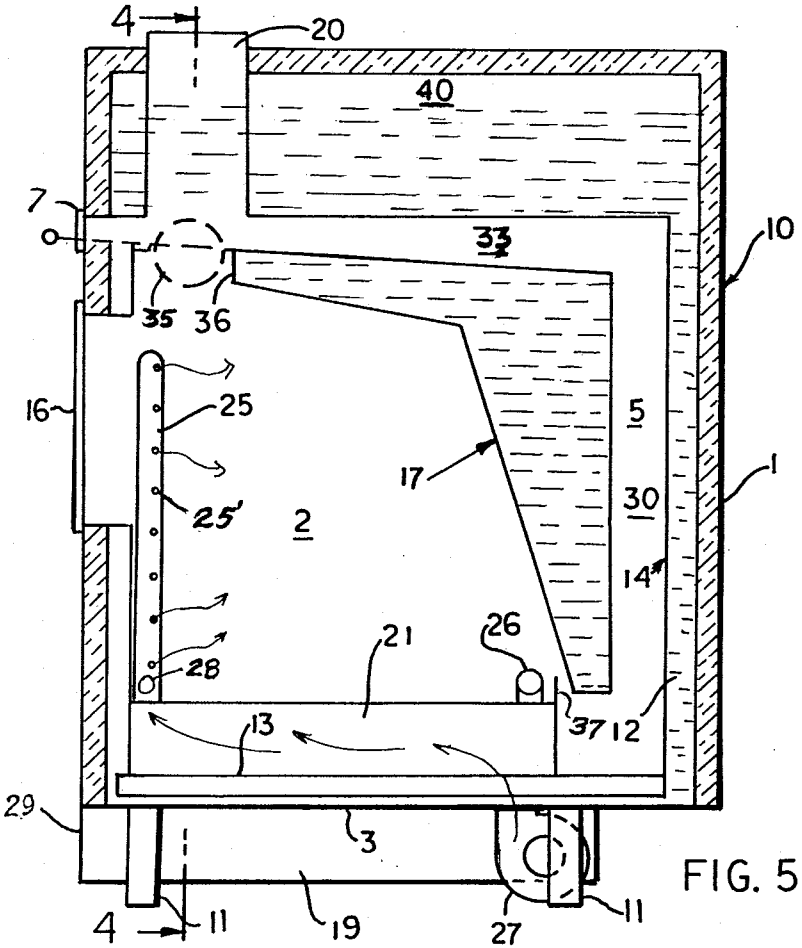
FIG. 5 is a longitudinal cross-sectional view taken on line 5—5 of FIG. 4.
Figure 4:
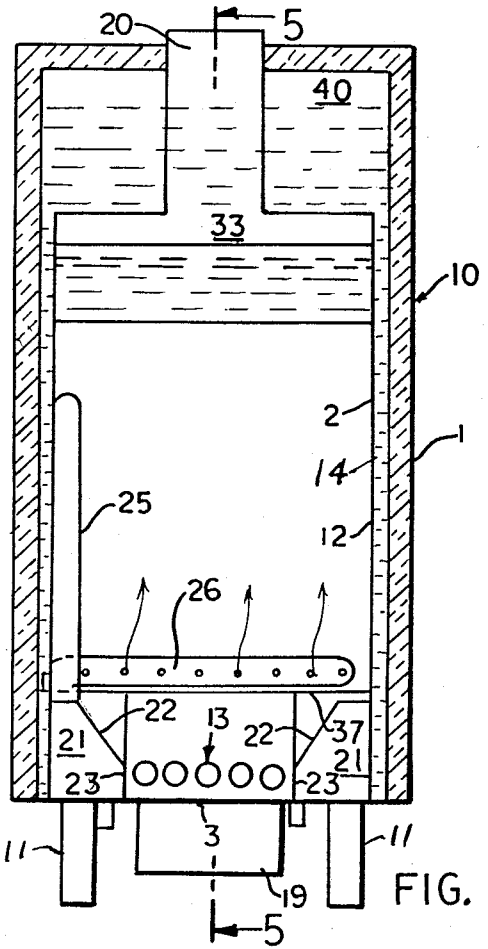
FIG. 4 is a lateral cross-sectional view taken on line 4—4 of FIG. 5.

Now with more particular reference to the drawing, I show a furnace 10 which is generally rectangular in configuration, having a top, bottom, sides, front and rear which may be covered by a steel sheet metal enclosure 1. The furnace 10 is supported on legs 11. The furnace 10 has insulation 12, which may be made of fiberglass or any other suitable insulation material, and a water jacket 14 is provided.

Figure 6:
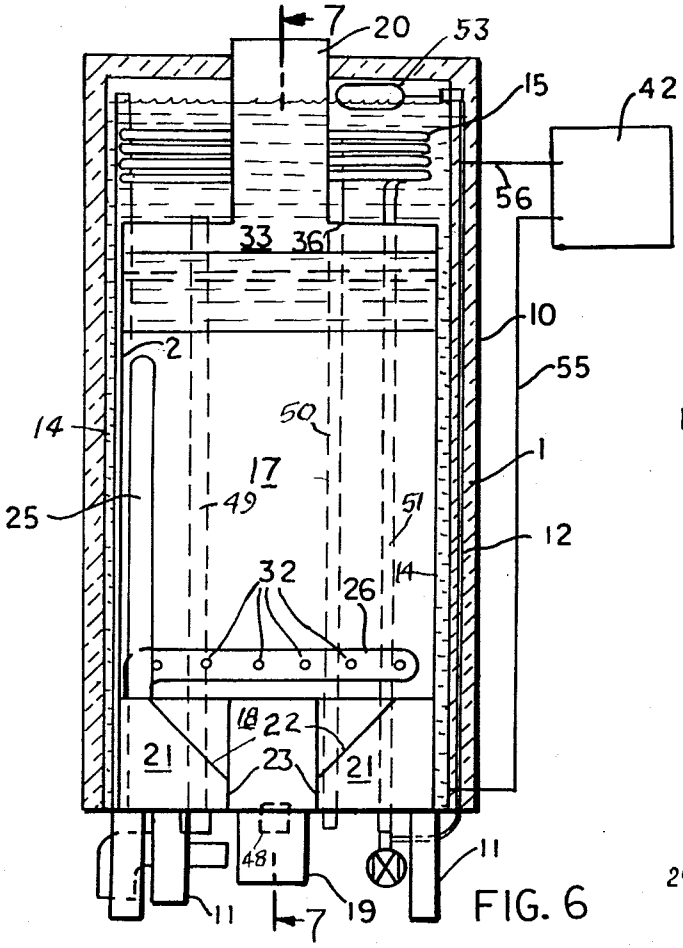
FIG. 6 is a cross-sectional view taken on line 6—6 of FIG. 7.

The water jacket 14 extends around the front, sides, rear and top of the furnace 10. Potable water for use as a hot water supply for domestic purposes may be heated in coil 15, or as an option the exchanger of FIG. 3, in liquid chamber 40, which will be connected to a water supply line 50 and return line 51. FIG. 6 shows supply line 49 and return 48 connected to a domestic heat exchanger(s) 42 in a space to be heated such as inside a home or other type building.

The furnace 10 has a front door 16 for loading fuel, an ash door 29 for cleaning out ashes that fall down through the grate 13 into ash container 19, a clean out door 7, and a flue 20. Tubes of grate 13 are supported at each end above the ash container 19. The flue 20 may be connected to a suitable chimney on inside units.

Figure 7:
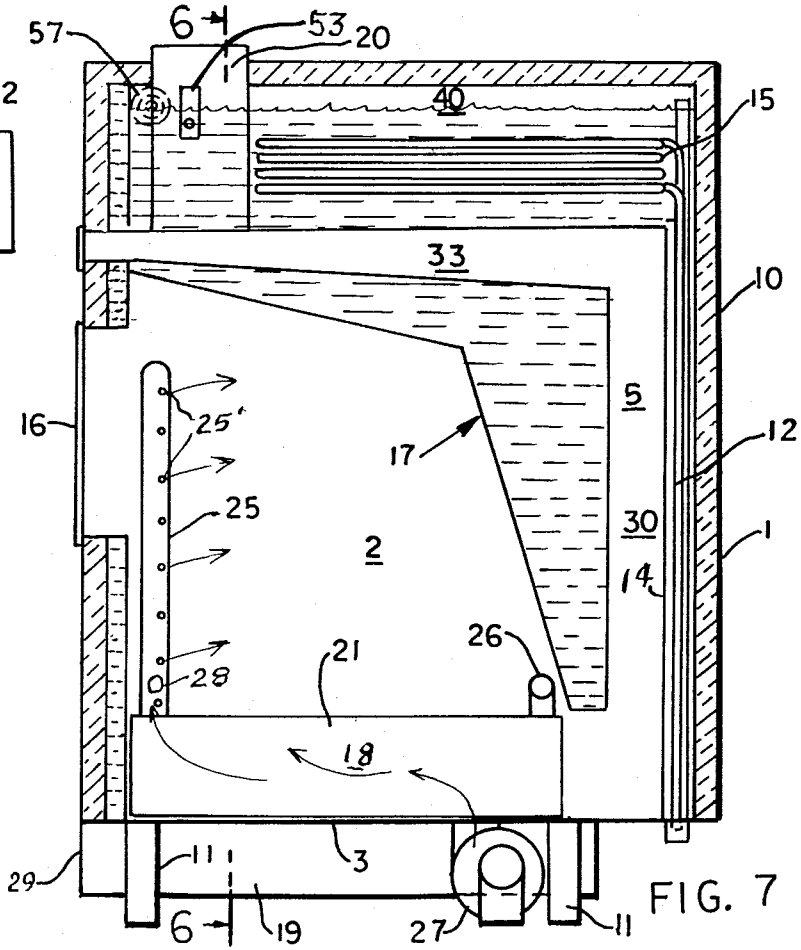
FIG. 7 is a cross-sectional view taken on line 7—7 of FIG. 6.

Air chamber 21 is provided at the side of the furnace 10 and extends from front to back. Air chamber 21 and a similarly shaped inactive chamber on the opposite side have inner inclined walls 22 that slope upwardly and outwardly. Vertical wall 23 on the active air chamber 21 has openings 24 for allowing air to enter the firebox 18. Air chamber 21 has vertical pipe 25 and a horizontal pipe 28 extending across the front and horizontal pipe 26 across the back. A blower 27 supplies air under pressure to the air chambers 21, which flows through pipes 25 and 26 to the fire. A liquid filled baffle 17 is spaced forwardly from the rear wall water jacket 14 and downwardly from the liquid chamber 40 providing a path behind and over liquid filled baffle 17, from the firebox 18, up through the back chamber 30 and through the top air chamber 33 to the flue 20. Thus combustion air is supplied by the blower 27 through the air chambers 21, out through openings 24 and through holes 25' of vertical pipe 25 and holes 32 of horizontal pipe 26 and 28 to the fire in the firebox 18. A damper 35 may be provided in an opening 36 in the horizontal leg of liquid filled baffle 17 to allow some of the air to go directly up through the flue 20. However, this is an option, and as shown in the embodiment of FIG. 7, may not be used.

Fuel is loaded through the front door 16. Primary combustion takes place in the firebox 18. Air is forced by the blower 27 into the main distribution chamber 21 where openings 24 and perforated arterial vertical pipes 25 and horizontal pipe 26 and 28 distribute "curtains" of air under, against and above the burning fuel in the firebox 18. The baffle arrangement and the air movement force the oxygen enriched gases down near the hot coals on the grate 13. This mixture of unburned gases is ignited and the resultant flame is directed under the hollow baffle 17 then upward through the back chamber 30 and forward horizontally towards the flue 20 through top air chamber 33. The baffle 17 divides the firebox and creates two distinct heating chambers; (1) the firebox 18 which is the area the fuel is loaded into and (2) the chamber 30 which adds almost fifty percent (50%) more heat exchange surface. An aquastat 53 activates the blower 27 on falling liquid temperature to increase the burn rate of the fire. A closing device on the blower keeps unwanted air from entering when the blower 27 shuts down. Ashes fall through the grate 13 to the ash container 19 below where they are removed through the ash door 29. Occasional cleanout of ash from the top of the hollow baffle 17 may also be done by removing the cleanout door 7.

The furnace 10 is constructed of steel plate, stainless steel sheet, and pipe as appropriate. The enclosure 1 is joined to the inner shell 2 at the baseplate 3. The inner shell 2 is welded to the baseplate 3. The outer containment shell is welded to the inner shell at the bottom. Staybolts are provided to prevent excess deflection of the flat surfaces from operating on static pressures. The liquid enters the water jacket through connection 48 and exits through pipe 49. A pressure relief device 60 is provided on the closed version; an overflow and re-fill device 53 is provided on the open version of a type familiar to those skilled in the art. The re-fill is activated when evaporation has caused the liquid level to fall. Furnace 10 must not be operated without liquid. The liquid chamber 40 contains an additional heat exchanger and a liquid out tube, overflow, temperature sensing device and a liquid level sensor of conventional types.

On open units where a heat exchanger 15 or 42 is used, the liquid may enter and exit through lines 55 and 56. In this case, the liquid used for heating the media is replenished through a valve on the heat exchanger which is activated by the liquid level sensor 53.

Domestic water may either enter the coil 15 directly from the potable source and bypass hot water holding tanks, or be piped into a loop with an existing hot water tank(s). When choosing to pipe into a loop with existing tank(s), a circulating pump is helpful.

The furnace 10 is insulated to minimize heat loss from the reservoir by insulation 12 which may be a high grade mineral/glass wool mat. Outer metal enclosure 1 is fastened by clips at the baseplate 3 to protect the furnace 10 from the elements. An uninsulated skirt 5 around the bottom houses the fittings, connections, blower and conceals the legs and base.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An outdoor woodburning furnace comprising:

an enclosure having an insulated top wall, insulated front wall, insulated rear wall, and insulated side walls, a water jacket disposed in said enclosure generally co-extensive with said insulated front wall, insulated rear wall, and insulated side walls, a grate in said enclosure, ash receiving means below said grate, a flue connected to said enclosure, a fuel loading door in said enclosure for feeding fuel to said firebox, an L-shaped hollow baffle adapted to contain heated liquid medium, said L-shaped hollow baffle suppported in said enclosure, having a horizontal leg spaced from said front wall, said L-shaped hollow baffle having a vertical leg spaced from said rear wall and extending upwardly, said hollow baffle being connected to said water jacket to accommodate circulation of said liquid medium, said hollow baffle and said rear wall providing an air flow space between said rear wall, said top wall and said hollow baffle for air to flow from said firebox to said flue whereby water in said water jacket and in said hollow baffle is heated by hot gases from fire in said firebox, said vertical leg being fixed to said rear end of said horizontal leg proceeding said path for hot gas from air flow between said rear wall and said vertical leg.

2. The furnace recited in claim 1 wherein air receiving means is provided in said enclosure at the side of said grate extending upwardly and outwardly from said grate defining with said grate a firebox.

3. The furnace recited in claim 2 wherein said air receiving means has holes therein directing air from said air receiving means to said firebox.

4. The furnace recited in claim 3 wherein air line means extends upwardly from said air receiving means and other air line means extends laterally from said air receiving means, openings in said air lines directing air to said fire in said firebox at spaced positions thereon.

5. The furnace recited in claim 4 wherein said air receiving means comprises a spaced air receiving container disposed above said grate and at the side of said grate and a similarly shaped but inactive container on the opposite side absorbs heat, said containers each having a vertical wall adjacent said grate and extending upwardly therefrom and an inclined wall inclining upwardly and outwardly from each said vertical wall, said vertical wall on the active side having spaced openings therein for directing air to fire on said grate whereby combustion air is provided.

6. The furnace recited in claim 5 wherein said grate comprises stationary, spaced tubes extending generally parallel to each other and parallel to said vertical walls, means connecting the inside of said tubes to the inside of said water jacket.

7. The furnace recited in claim 5 wherein said furnace has movable iron grates.

8. The furnace recited in claim 5 wherein tubular means is attached to at least one said container, said tubular means extending laterally adjacent the lower edge of said vertical leg of said liquid filled baffle, and spaced holes in said tubular means wherein combustion air is provided.

9. The furnace recited in claim 1 wherein said water jacket, adjacent said top wall, is relatively deep, a heat exchanger having tubes is disposed in said top reservoir, said heat exchanger tubes being connected to a source of potable water, additional exchangers may be connected to said first mentioned heat exchanger to provide heat transfer to a closed system.

10. The furnace recited in claim 1 wherein said flue communicates with the space between said water jacket adjacent said top wall and to said L-shaped baffle.

11. The furnace recited in claim 10 wherein, an opening is disposed through said horizontal leg of said L-shaped baffle in line with said flue, a damper is disposed in said opening whereby air from said firebox can be selectively directed to said flue, a switch is provided connected to means to activate said blower said switch being located adjacent said loading door to evacuate volatile gases from said firebox before opening said loading door.

12. The furnace recited in claim 1 wherein an ash container is disposed in the bottom of said firebox below said grate, an ash door communicates with said ash container.

13. The furnace recited in claim 1 wherein a front door is supported on said front wall communicating with the inside of said firebox.

14. An outdoor woodburning furnace comprising:

an enclosure having an insulated top wall, insulated front wall, insulated rear wall, a bottom wall and insulated side walls, a water jacket disposed in said enclosure generally co-extensive with said insulated front wall, insulated rear wall, and insulated side walls, a grate in said enclosure, ash receiving means below said grate, a flue connected to said enclosure, a fuel loading door in said enclosure for feeding fuel to said firebox, an L-shaped hollow baffle having a horizontal leg and a vertical leg, adapted to contain heated liquid medium, said hollow baffle being supported in said enclosure, said horizontal leg being spaced from said front wall, said top wall and said rear wall and extending upwardly and forwardly, said horizontal hollow leg being connected to said water jacket to accommodate circulation of said liquid medium, said vertical leg and said rear wall providing an air flow space between said rear wall, said top wall and said hollow baffle for air to flow from said firebox to said flue whereby water in said water jacket and in said hollow baffle is heated by hot gases from fire in said firebox, air receiving means is provided comprising a vertically extending wall extending from a position adjacent said bottom wall generally vertical to a position above said grate, an outwardly extending wall is attached to said vertically extending wall and a horizontally extending pipe is attached to said outwardly extending wall and communicates with said air receiving means whereby combustion air is supplied to said firebox.

15. The furnace recited in claim 14 wherein said air receiving means further comprises horizontally extending walls and vertically extending air pipes are attached to said horizontally extending walls of said air receiving means adjacent said front wall of said furnace, vertically extending spaced holes are formed in said pipes.

16. The furnace recited in claim 14 wherein said vertical walls of said air receiving means have horizontally spaced openings whereby air is directed from said air receiving means to said firebox.

17. The furnace recited in claim 14 wherein said horizontally extending pipe has horizontally spaced openings for directing air into said firebox.

18. The furnace recited in claim 17 wherein said horizontally extending pipe is disposed adjacent the lower edge of said L-shaped baffle.

19. The furnace recited in claim 18 wherein a blower is connected to said air receiving means for providing combustion air to said furnace.

20. The furnace recited in claim 19 wherein an aquastat is disposed in said water jacket, said aquastat is connected to said blower whereby said blower is started when water in said water jacket reaches a pre-determined temperature and is stopped when said water reaches a second pre-determined temperature.

* * * * *